United States Patent [19]

Pillot

[11] Patent Number: 4,623,194

[45] Date of Patent: Nov. 18, 1986

[54] BODY-SUPPORTING DEVICE FOR WHEELCHAIR FOR HANDICAPPED PERSON COMPRISING A STRUCTURE ALLOWING AN UPRIGHT POSITION

[75] Inventor: Bernard Pillot, Romans, France

[73] Assignee: International Diffusion Consommateur, France

[21] Appl. No.: 612,916

[22] Filed: May 22, 1984

[51] Int. Cl.[4] ..... A61G 5/00

[52] U.S. Cl. ..... 297/316; 297/411; 297/429; 297/464; 297/488; 297/DIG. 10

[58] Field of Search ..... 297/316, 345, 411, 417, 297/429, 464, 466, 487, 488, DIG. 4, DIG. 10; 280/242 WC, 289 WC; 16/367

[56] References Cited

U.S. PATENT DOCUMENTS

| | | | |
|---|---|---|---|
| 2,549,902 | 4/1951 | Hibbard et al. | 297/376 X |
| 2,598,985 | 6/1952 | Everest et al. . | |
| 2,675,060 | 4/1954 | Strand | 297/417 X |
| 3,023,048 | 2/1962 | Barton . | |
| 3,165,357 | 1/1965 | Ruedemann, Jr. | 27/488 X |
| 3,249,388 | 5/1966 | Jennings | 297/DIG. 4 |
| 3,640,571 | 2/1972 | Keropian . | |
| 3,899,042 | 8/1975 | Bonar | 297/487 |
| 4,054,319 | 10/1977 | Fogg, Jr. et al. . | |
| 4,065,179 | 12/1977 | Takasaki | 297/DIG. 4 X |
| 4,076,304 | 2/1978 | Deucher | 297/DIG. 10 X |
| 4,456,086 | 6/1984 | Wier et al. | 297/DIG. 10 X |

*Primary Examiner*—Francis K. Zugel
*Assistant Examiner*—Peter R. Brown
*Attorney, Agent, or Firm*—Bacon & Thomas

[57] ABSTRACT

The invention is concerned with assistance to handicapped persons. The body-supporting device for wheelchair for handicapped person is characterized in that it comprises: a first set of means comprising two rigid segments, each mounted on the backrest by an articulated system which blocks the segment in a vertical orientation as armrest or horizontal orientation as thoracic half-belt, and a second set of means comprising two cradel elements adapted to be immobilized in the same horizontal plane in alignment to form open leg guards fitting over the front of the subject's legs. The invention is applicable to wheelchairs.

9 Claims, 13 Drawing Figures

Fig 3
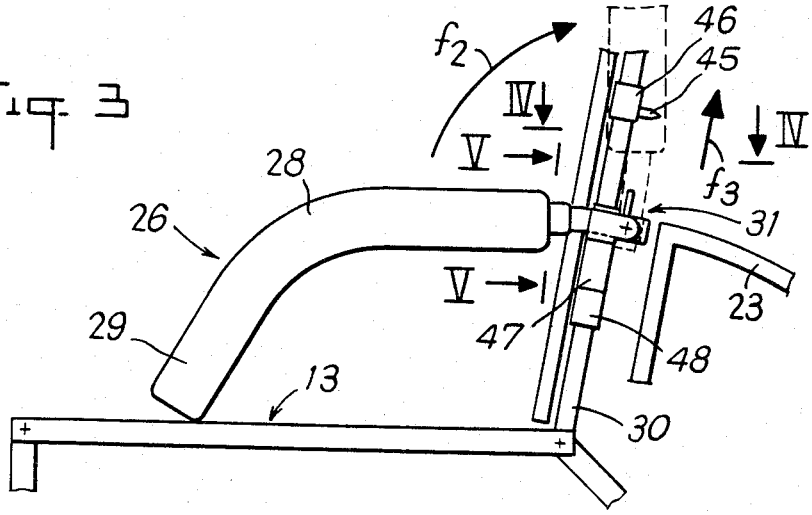
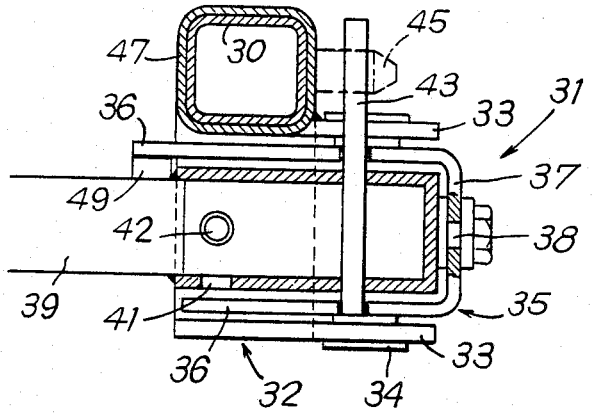
Fig 4
Fig 5
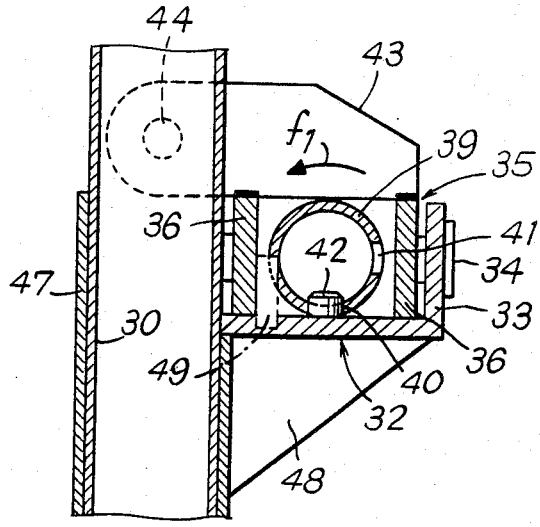

Fig. 6
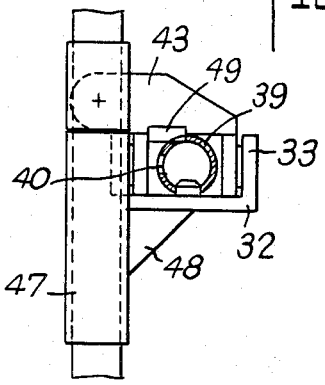
Fig. 7
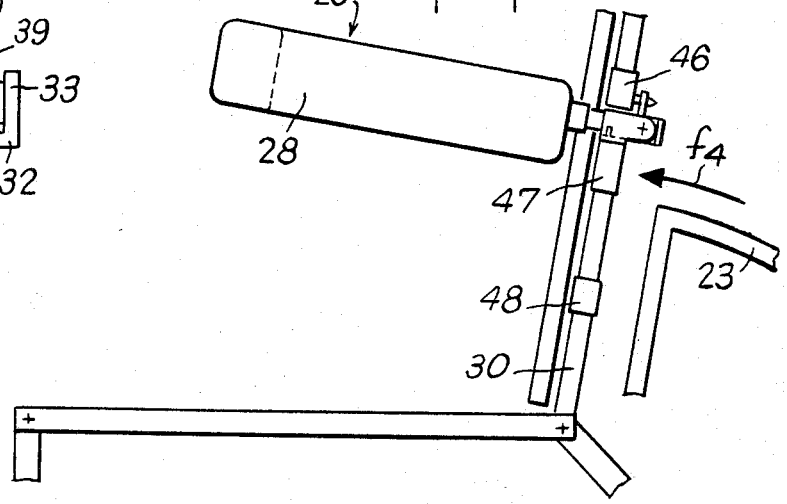
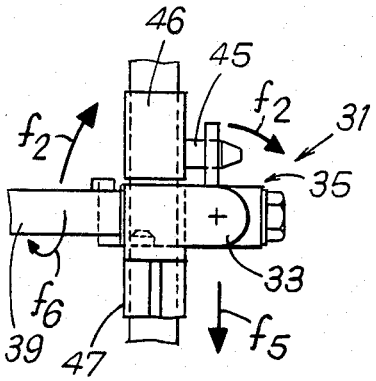
Fig. 8
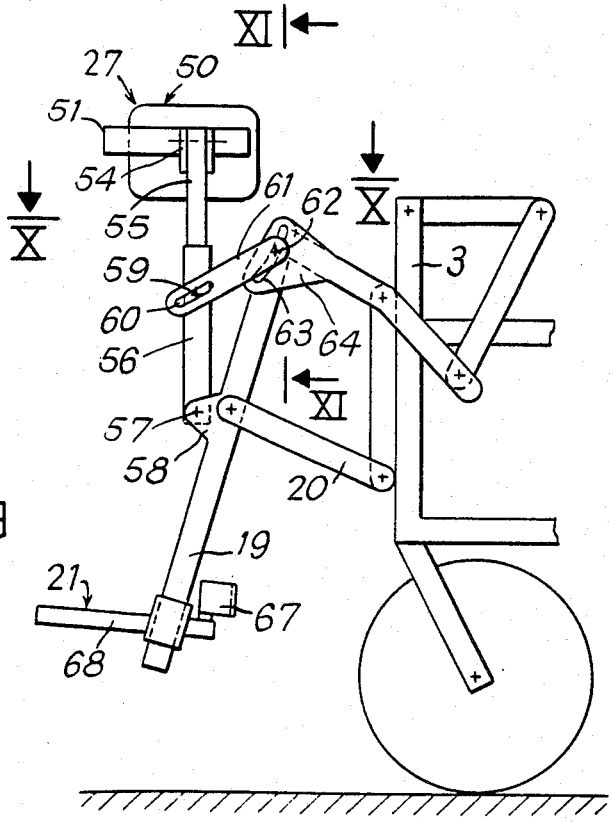
Fig. 9

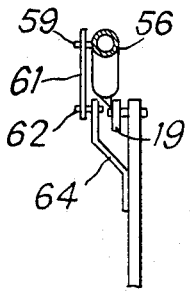
Fig. 10
Fig. 11
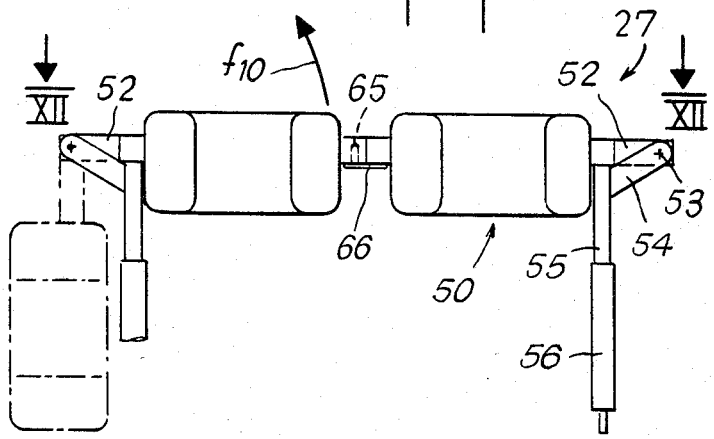
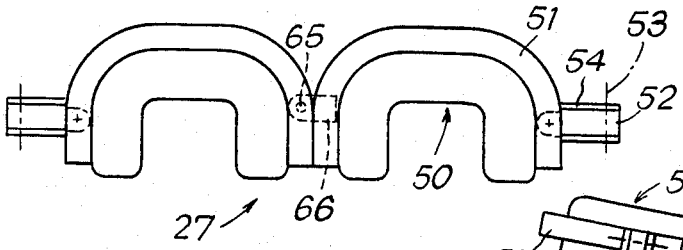
Fig. 12
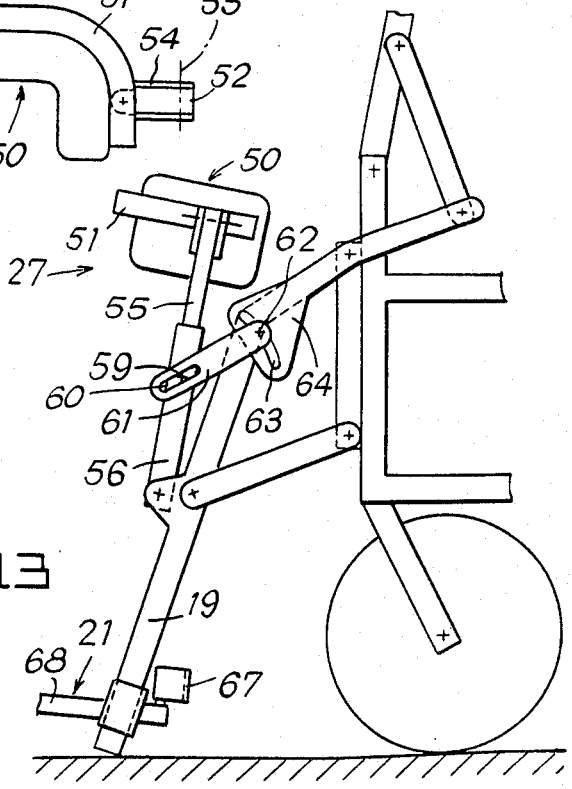
Fig. 13

BODY-SUPPORTING DEVICE FOR WHEELCHAIR FOR HANDICAPPED PERSON COMPRISING A STRUCTURE ALLOWING AN UPRIGHT POSITION

The present invention relates to wheelchairs used by handicapped persons and invalids and is equally well applicable to folding or non-folding wheelchairs.

The invention relates more particularly to wheelchairs of the type comprising an articulated structure constituted by a backrest, a seat and a footrest associated with a drive member for assisting or controlling the raising or lowering of the articulated structure with respect to a bearing frame.

These wheelchairs incontestably represent real progress as, in addition to allowing indispensable mobility, they enable the subject to be in an upright position, which is also indispensable to avoid the physical degradations resulting from remaining in sitting position for a long period of time.

The prior known technique proposes a certain number of solutions for making wheelchairs comprising an articulated structure allowing upright position.

These different propositions have their advantages and their drawbacks, but they generally enable a subject to remain adequately in upright position, at least partially.

However, it has been observed that such wheelchairs could not be used by all handicapped persons or invalids. In fact, for certain handicaps or invalidities, the subject has insufficient, or no muscular control to remain in stable position against the upright supporting plane represented by the raised articulated structure of a wheelchair.

In such cases, the fact of being upright represents a real danger for the subject who, in the absence of self-control, risks falling by slipping sideways or by his legs weakening or his torso collapsing.

Now, the possibility of being upright is important for all handicapped persons or invalids and perhaps even more so for those who do not possess physical control as in the cases mentioned above.

It is an object of the present invention to solve this important problem by proposing a body-supporting device designed for wheelchairs for handicapped persons comprising an articulated elevator structure making it possible to constitute a supporting plane in sitting position or a supporting plane in upright position for a subject.

One object of the invention is to propose a body-supporting device which may be fitted on any type of articulated structure as long as the latter is constituted by a backrest, an armature and a foot-rest assembly subjected to combined relative displacements.

Another object of the invention is to propose a body-supporting device which may easiy be fitted on any type of wheelchair and easily used or positioned to perform the function of supporting the body when the subject is in upright position.

It is a further object of the invention to propose a body-supporting device of very small dimensions capable of performing the function of which it is intended without representing or constituting by its component elements a hindrance for the subject.

Another object of the invention is to propose a body-supporting device offering possibilities of adjustment as a function of the morphological characteristics of the subject.

A further object of the invention is to propose a body-supporting device which is simple, robust, reliable and which does not require any particular maintenance to be in a good operational condition.

To attain the above objects, the body-supporting device for wheelchairs for handicapped persons comprising an articulated elevator structure fitted on the frame of such a wheelchair and the type constituted by a backrest, by a seat articulated on the backrest and on the frame, by a footrest assembly articulated on the seat and the frame and by means for relative pivoting, is characterized in that it comprises:

- a first set of means comprising two partly bent rigid segments, each mounted laterally on the corresponding upright of the backrest by an articulated system which holds and locks said segment
  - in a general vertical orientation in which it represents an armrest for a subject,
  - or in a general horizontal orientation in which it constitutes a thoracic half-belt for the subject,
- and a second set of means comprising two cradle elements each mounted, by two pivot pins of orthogonal directions, on the front upright of the footrest assembly, said cradle elements being associated with means for relative immobilization in a position of alignment in which they constitute open leg guards fitting over the front of the subject's legs.

The invention will be more readily understood on reading the following description with reference to the accompanying drawings, in which:

FIG. 3 is a side view showing one of the means of the invention in greater detail.

FIGS. 4 and 5 are sections taken, on a larger scale, along lines IV—IV and V—V of FIG. 3.

FIG. 6 is a transverse section, on a smaller scale, similar to FIG. 5, but illustrating another characteristic position.

FIG. 7 is a side elevation similar to FIG. 3, but illustrating the means according to the invention in another position of use.

FIG. 8 is a part side elevation showing, in greater detail, a functional relationship of certain of the elements of the first means of the invention.

FIG. 9 is a side elevation illustrating the positioning of another means of the body-supporting device.

FIG. 10 is a section taken along line X—X of FIG. 9.

FIG. 11 is a transverse view taken along line XI—XI of FIG. 9.

FIG. 12 is a plan view taken along line XII—XII of FIG. 11.

FIG. 13 is a side elevation similar to FIG. 9 but illustrating the same technical means in another position of use.

Figure 1:
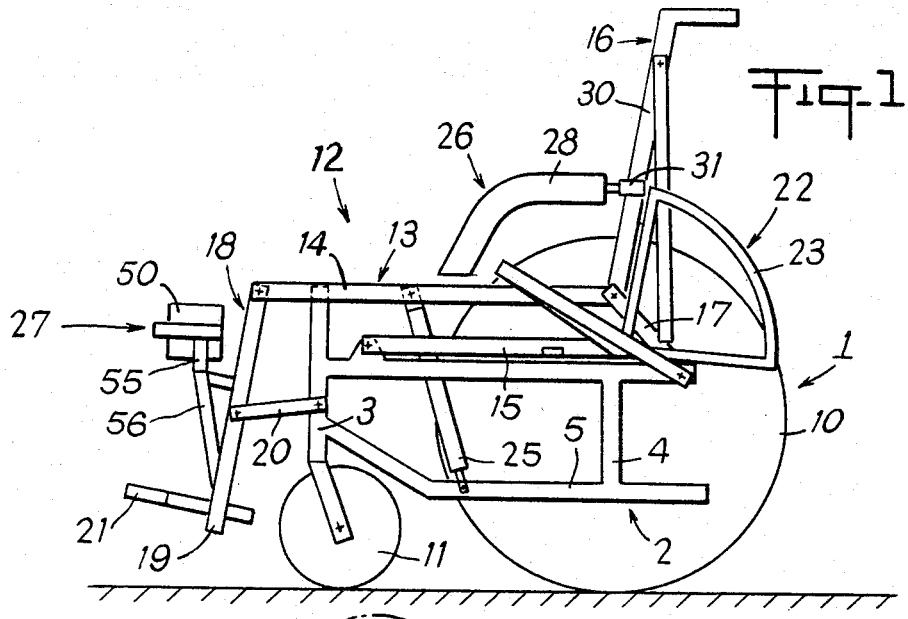
FIGS. 1 and 2 are schematic views of a wheelchair comprising an articulated structure ensuring upright position and illustrating the device according to the invention for maintaining in two particular positions of use.

Referring now to the drawings, FIG. 1 schematically shows a wheelchair 1 comprising a frame 2 constituted by front uprights 3 and rear uprights 4 connected together by sills 5 and crosspieces 6 (not shown). The frame 2 is provided, in conventionally known manner, with bearing and driving wheels 10 and with swivelling guiding wheels 11. The above frame 2 corresponds to a wheelchair of rigid design but it is obvious that a folding wheelchair has substantially the same form. In fact, in such a case, the crosspieces 6 (not shown) are replaced by equivalent foldable elements, of design known per se, enabling the frame to be maintained in the position of use or, on the contrary, enabling its dimensions in width to be reduced.

The frame 2 described hereinabove is fitted with an articulated elevator structure 12 adapted to allow a subject S to be in upright position. By way of example, structure 12 comprises a seat 13 comprising two lateral deformable quadrilaterals principally formed by two sills 14 and 15 articulated on the front part of the frame 2. The structure further comprises a backrest 16 constituted by two lateral trilaterals which are articulated on the sills 14 and 15 by means of two connecting rods 17 common to the sills 14-15. The articulated structure 12 is completed by a footrest assembly 18 principally formed by two lateral deformable quadrilaterals each including a front upright 19, a connecting rod 20, a part of the sill 14 and a part of the upright 3 of the frame 2. The assembly 18 supports one or two footrests 21 of known nature, preferably fitted with heel elements (not shown in FIGS. 1 and 2).

The articulated structure 12 is connected to the frame 2 by two manoeuvring assemblies 22 each comprising a lever 23 and an articulated system 24 for immobilizing, by geometrical locking, the articulated structure 12 in a stable sitting position or in a stable raised upright position. The manoeuvring assemblies 22 are completed by at least one drive member 25 such as a spring jack interposed between the frame 2 and for example the seat 13.

FIG. 1 shows the articulated structure 12 in the stable sitting position, immobilized by the articulated systems 24 of assemblies 22.

Figure 2:
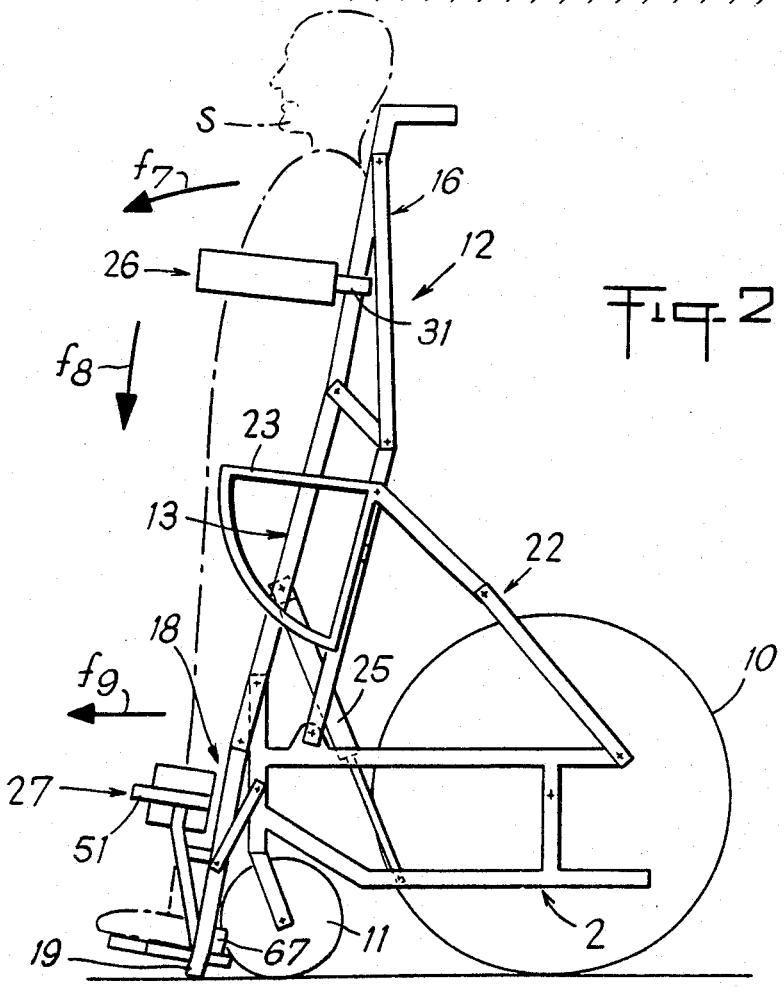

FIG. 2 shows the same articulated structure in stable raised or upright position, immobilized by the articulated systems 24. This FIG. 2 enables the relationship of articulation existing between the seat, the backrest and the footrest assembly 18, elevated by the manoeuvring assemblies 22 and the or each drive member 25, to be understood.

The object of the invention is to provide a device for ensuring body-support of a subject S, as shown in chain-dotted lines, brought into an upright position further to the elevation of the articulated structure 12. The object of the invention aims at making up for the lack or absence of physical control of the subject S to remain safely in the stable upright position illustrated in FIG. 2.

The body-supporting device according to the invention comprises a first set of means 26 adapted to be fitted on the backrest and a second set of means 27 adapted to be fitted on the footrest assembly 18.

The first set of means 26 comprises two rigid segments 28 presenting a bent or arched terminal part 29. Each segment 28 is mounted on the corresponding upright 30 of the backrest by an articulated system 31 described in greater detail with reference to FIGS. 4 and 5.

Each articulated system 31 comprises a fork joint 32 fitted on the upright 30 and forming two parallel flanges 33 extending towards the rear of the wheelchair. The flanges 33 support, by a substantially horizontal pivot pin 34, a stirrup 35 whose parallel arms 36 extend internally and parallel to the flanges 33. The web 37 of the stirrup 35 rotatably supports a pivot 38 fast with an extension 39 of the segment 28 and extending opposite the terminal part 29. The extension 39 presents two holes 40 and 41 of radial direction made to cooperate with a catch 42 projecting from the web of the fork joint 32. The holes 40 and 41 represent means for locking the extension 39 in rotation and are made so as to be able to maintain the plane of the segment 28 either in a substantially vertical orientation or in a substantially horizontal orientation after rotation in the direction of arrow $f_1$ in FIG. 5. The holes 40 and 41 are, in the present case, separated from one another, in consideration of the direction of arrow $f_1$ with respect to the fixed reference constituted by the catch 42, by an angular area equal to 270° C.

The stirrup 35 supports, from the upper edges of its flanges 36, a bar 43 which extends along a plane parallel to that of the backrest to be permanently disposed behind the corresponding upright 30 by being oriented towards the bar 43 of the homologous articulated system 31. The bar 43 comprises, in its terminal part facing the upright 30, a hole 44 adapted to cooperate with a finger 45 as shown in chain-dotted lines in FIG. 4.

Finger 45 extends from the upright 30 towards the rear and is borne, in the example of construction illustrated, by a ring 46 adjustably mounted on the upright 30. The ring 46 represents an upper stop for the articulated system 31 mounted in such a case so as to be free axially but immobilized angularly, for example, via a slide block 47 fitted on the upright 30. In such a case, the slide block bears the fork joint 32. The slide block 47 is limited in downward axial slide by a ring 48 with adjustable position, of the same type as ring 46.

Each articulated system 31 further comprises sensitive or tactile means for determining the position of locking of the segment 38. These means comprise a catch 49 added to the extension 39 so as to be able to cooperate with one of the flanges 36 of the stirrup 35 in register with the two locking positions established by cooperation of the catch 42 with one or the other of the holes 40 and 41. In the example illustrated in FIG. 5, the catch 49 is added so as to extend tangentially, presenting a thickness and a length determined so that it can cooperate with the flange 36 by a lateral face or by a transverse edge in one and the other position as will be seen from the following.

It should be noted that the hole 40 is made in the extension 39 so as to immobilize or lock the segment 28 in a substantially vertical plane in which the terminal part 29 is oriented downwardly in the direction of the seat 13.

The first set of means described hereinabove is used in the following manner:

In the cases of using the wheelchair according to FIG. 1, for which the articulated structure 12 offers a supporting plane in sitting position for a handicapped person or invalid, the two segments 28 are placed as illustrated in FIGS. 3, 4 and 5. The two segments 28 are thus maintained by cooperation of the hole 40 with the catch 42 in a substantially vertical plane in which the terminal parts 29 are oriented towards the seat 13.

In this state, each segment 28 represents an armrest as well as a lateral guard by extending between the backrest and the seat.

The position of each armrest is maintained without risk of untimely disengagement by the cooperation of the hole 40 with the catch 42, cooperation which is all the more consolidated as the segments 28 serve as armrests. No lateral displacement of the armrest 28 can occur in view of the angular immobilization of the fork joint 32 with respect to the upright 30, either directly or via the slide block 47.

If the articulated structure 12 is to be displaced in elevation in order to constitute a supporting plane for the subject S in upright position, each segment 28 is pivoted in the direction of arrow $f_2$ (FIG. 3) to rotate the stirrup 35 on pin 34 in order to disengage the hole 40 with respect to the catch 42. When this disengagement occurs, the segment 28 is rotated in the direction of arrow $f_1$ (FIG. 5) over an angular area which is determined by the catch 49. In the present case, the catch 49 is guided, after a rotation through 270°, in cooperation with the inner flange 36 as illustrated in FIG. 6. The subject or the user is therefore certain, by touching the stop, that the hole 41 is then placed in register with the catch 42. The segment 28 is then pivoted in the direction opposite to arrow $f_2$ so as to establish cooperation betwen the hole 41 and the catch 42 effecting locking of the segment 28.

In this state, the segment 28 is oriented substantially horizontally, perpendicularly to the plane of the backrest 16. The corresponding terminal part 29 is thus directed towards the second segment 28 and then represents a thoracic half-belt following the shape of or partially surrounding the chest of the subject who is held laterally and antero-posteriorly with respect to the backrest 16 when the two segments 28 have been brought into the above position.

The two half-belts pass around the chest, below the arm joints, this giving the subject who is immobilized against the backrest 16 complete freedom of movement.

In the preferred embodiment illustrated in FIGS. 3, 4 and 5, each segment 28 is in addition subjected, after the relative movements in the direction of arrows $f_1$ and $f_2$, to a vertical displacement in direction $f_3$ (FIG. 3) so as to bring the hole 44 in the bar 43 in approximate register with the finger 45 of the stop 46. This position is reached when the upper edge of the slide block 47 cooperates with the base of the ring 46. In this position, the segment 28 may be displaced in the direction opposite that of arrow $f_2$ so as to pivot, in the corresponding directon, the stirrup 35 which ensures engagement of the bar 43 by the hole 44 on the finger 45.

The segment 28 is then maintained as previously, but in an elevated position with respect to that occupied as armrest guard.

This presents the advantage of being able to adapt exactly to the desired position the level of the segment 28 in thoracic half-belt position by adjusting the ring 46. Such a possibility gives the subject maximum comfort as a function of his morphology.

FIG. 7 shows that the adaption of the segments 28 to the thoracic belt function is carried out prior to the elevation of the articulated structure 12. This Figure also shows that the adaptation of the segments 28 allows complete freedom of displacement for the manoeuvring assemblies 22 in the direction of arrow $f_4$ when the subject wishes, by manually acting on these assemblies, to initiate and assist the action of the driving member 25 or to control the action of the latter in order to control the relative movement of the elements constituting the articulated structure 12 with a view to bringing the latter from the position according to FIG. 1 to the position according to FIG. 2 in the upright state.

After return into sitting position, the subject can return each segment 28 into the armrest position by pivoting in the direction of arrow $f_2$ in order to disengage the bar 43 with respect to the finger 45. When such disengagement has occurred, the slide block 47 may be descended in the direction of arrow $f_2$ and simultaneously or thereafter the segment 28 rotated in the direction of arrow $f_6$ as is illustrated overall in FIG. 8. The return of the segment 28 into correct armrest/guard position is determined by bringing the lateral face of the catch 49 against the flange 36, as illustrated in FIG. 5, determining the register of the hole 40 with the catch 42. A pivoting in direction opposite to that of arrow $f_2$ makes it possible to pivot the stirrup 35 in order to obtain relative penetration of the catch 42 in the hole 40 re-establishing locking of the segment 28 in the original position.

Although the two segments 28 provide thoracic support for the subject S against the plane of the backrest 16, in certain cases, they are insufficient to effectively oppose a weakening of the lower limbs resulting from a total or partial loss of physical control thereof. It is for this reason that the body-supporting device according to the invention also comprises the second set of means 27.

FIGS. 9 to 12 show that the second set of means 27 comprises two open leg guards 50 which are adapted to fit over the front of the subject's legs, abutting substantially below the tibia in order to immobilize the lower limbs laterally and in the antero-posterior plane.

Each leg guard 50 is constituted by a cradle element 51 comprising an extension 52 which is articulated by a pin 53 on an offset fork joint 54 extending from the upper end of a cylindrical rod 55. The lower terminal part of the rod 55 is mounted to rotate inside a shaft 56 adapted to be fitted on one of the uprights 19 of the footrest assembly 18.

The shaft 56 is to this end articulated by a pin 57 on a tab 58 offered by the upright 19. The shaft 56 is maintained in a substantially vertical position by a pivot 59 provided in its upper terminal part to be adjusted in position inside an oblong slot 60 presented by a rod 61 for connection with the upright 19. The terminal part of the rod 61 opposite the slot 60 is provided with a pivot 62 mounted to be adjustable in position inside an arcuate slot 63 presented by a plate 64 extending laterally to the upper crosspiece constituting the corresponding lateral deformable quadrilateral connecting the footrest assembly 18 to the seat 13. For reasons of facility of presentation, the construction illustrated in FIG. 2 is different from that given in FIG. 1 as far as the connection between the footrest assembly 18 and the seat 13 is concerned. However, it appears that this difference concerns only the structure of the technical means, the function assumed by this connection being in both cases the same, i.e. the pivoting of the seat 13, urged by the driving member 25, brings about the combined displacement of the assembly 18.

The shafts 56 of the two leg guards 50 are mounted on homologous uprights 19 and the rods 55 are rotatably engaged so that the fork joints 54 are oriented towards the outside opposite each other. In this way, by pivoting on pins 53, the leg guards 50 may be placed laterally and on the outside as shown in chain-dotted lines or, on the contrary, may be returned substantially horizontally in mutual alignment facing the plane of the assembly 18 passing through the uprights 19. The leg guards 50 are maintained in mutual alignment by immobilization means comprising a hole 65 made in one of the cradle elements 51 and a lug 66 projecting from the cradle element 51 of the second leg guard.

In this way, it becomes possible to maintain the two leg guards 50 efficiently in a stable position in which they are maintained by the pins 53, by abutting on the upper parts of the rods 55. In this position, the leg guards 50 fit over the legs of a subject S.

The shafts 56 are adjusted in relative position via the pivots 59 so as to adapt the position of the leg guards 50 in mutual alignment as a function of the morphology of the subject and in particular of the length of the femurs. This adjustment is effected in correlation with that of the positon of the pivot 62 so that, in the position of maximum elevation corresponding to the upright position as illustrated in FIG. 13, the two leg guards 50 fit over the front of the two legs without creating any unbearable strain and to immobilize them laterally and antero-posteriorly in combination with the support of the feet against the heel elements 67 borne by the footrest plane 68.

A comparison of FIGS. 9 and 13 will show that the oblong slot 60 and the arcuate slot 63 offer a possibility of adjusting the leg guards 50 in the two positions as a function of the morphology of the subject to give maximum comfort and to establish a lateral and antero-posterior support opposing any weakening or collapse in the upright position as shown in FIG. 2.

It goes without saying that the leg guards 50 are placed in position as illustrated in FIGS. 11 and 12 prior to the elevation of the articulated structure 12, so as to constitute a stop for the legs in the event of accentuated weakening of the knees during elevation.

The subject S, supported by the two sets of means 26 and 27, is consequently efficiently and comfortably immobilized against a tendency of the torso to sag in the direction of arrow $f_7$ or a tendency to collapse in the direction of arrow $f_8$ as a result of the knees bending and moving in the direction of arrow $f_9$.

The means 27 may be rapidly disengaged in the sitting position. In fact, it suffices to move the leg guards 50 successively in the direction of arrow $f_{10}$ to pivot the cradle elements towards the outside, as illustrated in chain-dotted lines in FIG. 11.

If desired, it is also possible to remove the leg guards 50 rapidly by extracting the rods 55 with respect to the shafts 56.

The invention is not limited to the embodiment described and shown as various modifications may be made thereto without departing from its scope. Although this has not been shown, adjusting means may be provided between the shafts 56 and the rods 55.

What is claimed is:

1. A device for supporting the body of a handicapped person within a wheelchair of the type including an articulated elevator structure fitted on the frame of the wheelchair, a backrest having a pair of uprights, a seat articulated on the backrest and on the frame, a footrest assembly having a pair of front uprights and articulated on the seat and the frame, and means for relative pivoting, the device comprising:

(a) a first set of means including two partly bent rigid segments, each segment mounted laterally on a corresponding upright of the backrest by an articulated system which holds and locks the segment in either a generally vertical orientation wherein the segment defines an armrest or in a generally horizontal orientation wherein the segment defines a thoracic half-belt for the person;

(b) each articulated system including a fork joint supporting a stirrup by a substantially horizontal pivot pin, a pivot whose axis is substantially at right angles to the pivot axis connecting the web of the stirrup to an extension of the segment, and a catch borne by the fork joint for engaging within either one of two holes formed in the extension for immobilizing the segment in either the vertical or the horizontal orientation; and (c) a second set of means including two cradle elements, each cradle element being mounted by two pivot pins of orthogonal directions on a corresponding front upright of the footrest assembly, the cradle elements including means for relative immobilization in a position of alignment wherein the cradle elements are in engagement over the front portions of the legs of the person.

2. The device of claim 1 wherein the holes provided in the extension are radially spaced from each other by an angle of about 90°.

3. The device of claim 1 wherein the stirrup includes a pair of flanges and each extension includes a stop catch cooperating with one of the flanges to permit the person to determine the positions of the segment.

4. A device for supporting the body of a handicapped person in a wheelchair of the type including an articulated elevator structure fitted on the frame of the wheelchair, a backrest having a pair of uprights, a seat articulated on the backrest and on the frame, a footrest assembly having a pair of front uprights and articulated on the seat and the frame, and means for relative pivoting, the device comprising:

(a) a first set of means including two partly bent rigid segments, each segment mounted laterally on a corresponding upright of the backrest by an articulated system which holds and locks the segment in either a generally vertical orientation wherein the segment defines an armrest or in a generally horizontal orientation wherein the segment defines a thoracic half-belt for the person;

(b) each articulated system including a fork joint borne by a slide block mounted on a corresponding upright of the backrest for free axial movement therealong between upper and lower adjustable stops, and a stirrup provided with a bar extending substantially horizontal and parallel to the upright, the stirrup including a hole provided in a terminal portion thereof for the relative engagement therein by a finger projecting from the upper stop; and (c) a second set of means including two cradle elements, each cradle element being mounted by two pivot pins of orthogonal directions on a corresponding front upright of the footrest assembly, the cradle elements including means for relative immobilization in a position of alignment wherein the cradle elements are in engagement over the front portions of the legs of the person.

5. The device of claim 1 or 4 further including:

(a) a vertical shaft carried by each corresponding front upright of the footrest;

(b) each cradle element including a lower terminal part rotatably engaged in the vertical shaft;

(c) each vertical shaft including a horizontal pivot pin provided at a lower portion thereof;

(d) a rod articulated on the footrest assembly, the rod including an oblong adjustment slot at one end thereof; and (e) the pivot at the upper part of the vertical shaft being engaged within the oblong adjustment slot of the rod.

6. The device of claim 5 further including:

(a) an upper cross piece connecting the footrest assembly and the seat;

(b) an offset plate including an arcuate slot carried by the cross piece; and (c) the other end of the rod including a pivot engaged within the arcuate slot.

7. A device for supporting the body of a handicapped person within a wheelchair of the type including an articulated elevator structure fitted on the frame of the wheelchair, a backrest having a pair of uprights, a seat articulated on the backrest and on the frame, a footrest assembly having a pair of front uprights and articulated on the seat and the frame, and means for relative pivoting, the device comprising:

(a) a first set of means including two partly bent rigid segments, each segment mounted laterally on a corresponding upright of the backrest by means for holding and locking the segment in either a generally vertical orientation wherein the segment defines an armrest or in a generally horizontal orientation wherein the segment defines a thoracic half-belt for the person;

(b) a second set of means including two cradle elements, each cradle element being mounted by two pivot pins of orthogonal directions on a corresponding front upright of the footrest assembly, the cradle elements including means for relative immobilization in a position of alignment wherein the cradle elements are in engagement over the front portions of the legs of the person;

(c) a vertical shaft carried by each corresponding front upright of the footrest, each cradle element including a lower terminal part rotatably engaged in the vertical shaft, each vertical shaft including a horizontal pivot pin provided at a lower portion thereof and a pivot provided at an upper portion thereof, a rod articulated on the footrest assembly, the rod including an oblong adjustment slot at one end thereof, the pivot at the upper part of the vertical shaft being engaged within the oblong adjustment slot of the rod;

(d) an upper cross piece connecting the footrest assembly and the seat, an offset plate including an arcuate slot carried by the cross piece, the other end of the rod including a pivot engaged within the arcuate slot; and (e) whereby the vertical shaft may be pivoted to a position such that the cradle elements support the person in an upright position.

8. The device of claim 7 wherein the means for relative immobilization of the cradle elements includes an aperture provided in one cradle element and a lug provided in the other cradle element, wherein the lug is engageable within the aperture.

9. The device of claim 7 wherein the articulated elevator structure of the wheelchair includes means for permitting the structure to define a supporting plane for the person in a sitting position and extendable to permit the person to assume at least a partially upright position.

* * * * *